United States Patent [19]

Chong

[11] Patent Number: 4,492,261

[45] Date of Patent: Jan. 8, 1985

[54] SHADING SYSTEM

[75] Inventor: Ian Chong, New York, N.Y.

[73] Assignee: General Drapery Services, Inc., New York, N.Y.

[21] Appl. No.: 515,322

[22] Filed: Jul. 19, 1983

Related U.S. Application Data

[63] Continuation of Ser. No. 305,869, Sep. 28, 1981, abandoned.

[51] Int. Cl.[3] ..... E06B 9/20

[52] U.S. Cl. ..... 160/319

[58] Field of Search ..... 160/314, 319, 323–326

[56] References Cited

U.S. PATENT DOCUMENTS

| | | | |
|---|---|---|---|
| 1,338,223 | 4/1920 | Heath | 160/314 |
| 1,917,449 | 7/1933 | Koller | 160/314 |
| 3,854,517 | 12/1974 | Nakamura | 160/323 R |

*Primary Examiner*—Peter M. Caun

*Attorney, Agent, or Firm*—Jordan and Hamburg

[57] ABSTRACT

The present invention is directed to a shading system in which the shade cord and the winding coil spring are coaxially arranged along a winding shaft or hub for the shade cord. Additionally, the pair of end supports supporting the shade or shade roller or tube are provided with a series of horizontally-extending slots so that the shading device can be arranged to hang in directions other than just straight down from the mounting shade tube.

5 Claims, 8 Drawing Figures

SHADING SYSTEM

REFERENCE TO RELATED APPLICATION

This is a continuation of Ser. No. 305,869, filed Sept. 28, 1981 now abandoned.

BACKGROUND OF THE INVENTION AND PRIOR ART STATEMENT

The present invention is directed to a unique and novel shading system for hanging shades over a window, doorway, or similar edifice.

Shading systems comprising a roller affixed to a window frame and a take-up reel for the shade cord are know in the art. For example, U.S. Pat. Nos. 2,055,862 (Friedman), 2,658,234 (Trammell, Sr., et al), 2,702,402 (Haas), 2,766,448 (Trammell, Jr.) and 3,812,588 (Bennett) all disclose types of shades or rollers. However, it has previously been difficult to arrange a shade to hang in a particular fashion from the top of a window, doorway, etc., to conceal the cord from view. It has also been difficult to construct a take-up reel for the cord of fairly modest size, since the lower end of the shade cord had to be affixed to a flexible, elastic winding coil around the take-up reel.

It is now possible to prepare a take-up reel or control mechanism of a shade system in any number of sizes smaller than conventionally available dimensions, which will advantageously fit in any size window reveal, or mullion including smaller window reveals in more modern buildings which are designed to conserve energy. It is also now possible to arrange a shade system where the shade may hang down from the top roller in any fashion other than just directly vertically down from the roller. This arrangement can be used to conceal any unsightly appearance of either the shade cord and/or the take-up reel from view.

Accordingly, it is an object of the present invention to provide a shading system in which the shade may hang from a roller in any number of positions other than just vertically down.

It is also an object of the present invention to provide a shading system in which the take-up reel or strap control mechanism may be more compactly designed to fit any size window reveal.

It is another object of the present invention to provide a shading system in which tangling or jamming of the shade cord or strap is minimized.

It is a further object of the present invention to provide a shading system with improved aesthetic appearance.

It is still a further object of the present invention to provide for improved conservation of energy in shading design.

Other objects of the present invention will become apparent from the accompanying description with respect to the drawings.

SUMMARY OF THE PRESENT INVENTION

The present invention is directed to a shading system comprising a shade roller or tube and two lateral end supports to support the shade roller in which the substantially rectangular end supports are each provided with longitudinally-extending slots. The shade is run through any corresponding pairs of slots on the two end supports to hang downwardly while suspended from the shade roller. The end supports are provided with these horizontally-extending slots in front of, in back of, and beneath the shade roller so that the shade may hang downwardly in any fashion other than just vertically down off the roller. For example, the shade may be run through a pair of corresponding slots in front of the roller to cover from view the cord or strap used to raise and lower the shade by turning the roller. Alternatively, the shade may be run through a pair of corresponding slots behind the roller, near a window for example, in order to better insulate against passage of air of a different temperature into a room.

The shading system of the present invention also comprises mounting caps affixed to opposite ends of the roller or tube which are in turn, affixed to the pair of lateral end supports. A hollow pulley is inserted over the tube and mounting caps before mounting onto the end supports. The roller or tube and the mounting caps are each provided with contiguous indentations or keyways to support the key of a shade (The key, to which the shade material is attached, rests within the keyway or indentation and the shading material is then wound around the roller). The pulley hole is provided with a complementary protrusion to snugly fit the indentations or keyways in the roller and mounting caps so that the roller can be securely turned to raise or lower the shade.

The shading system of the present invention additionally comprises a cord or strap which is used to turn the pulley to rotate the roller, raising or lowering the shade. The strap is wound around the pulley at one end and is connected to a control box or mechanism at its other end. The strap passes into the control mechanism through a box past a pivotal retaining mechanism where it is wound around an axle or hub. Adjacent to the strap in said control mechanism is a coil spring which is coaxially wound around the strap hub in an opposite direction from the strap. This coaxial arrangement of the strap and of the coil spring along the hub allows for reduction of the overall size of the control mechanism. Thus, the control mechanism can be designed to fit within any size window reveal, particularly smaller window reveals in more modern buildings which are designed with a minimum of corners for insulation purposes.

Additionally, the coil spring is secured at its outboard end and is mobile at its inboard end, which adds to the stability of the present shading system. There is less chance of the control strap, cord and/or the coil spring from tangling or jamming as the shade is raised or lowered.

The invention will now be explained in further detail with respect to the drawings.

DETAILED DESCRIPTION OF A PREFERRED EMBODIMENT

Figure 1:
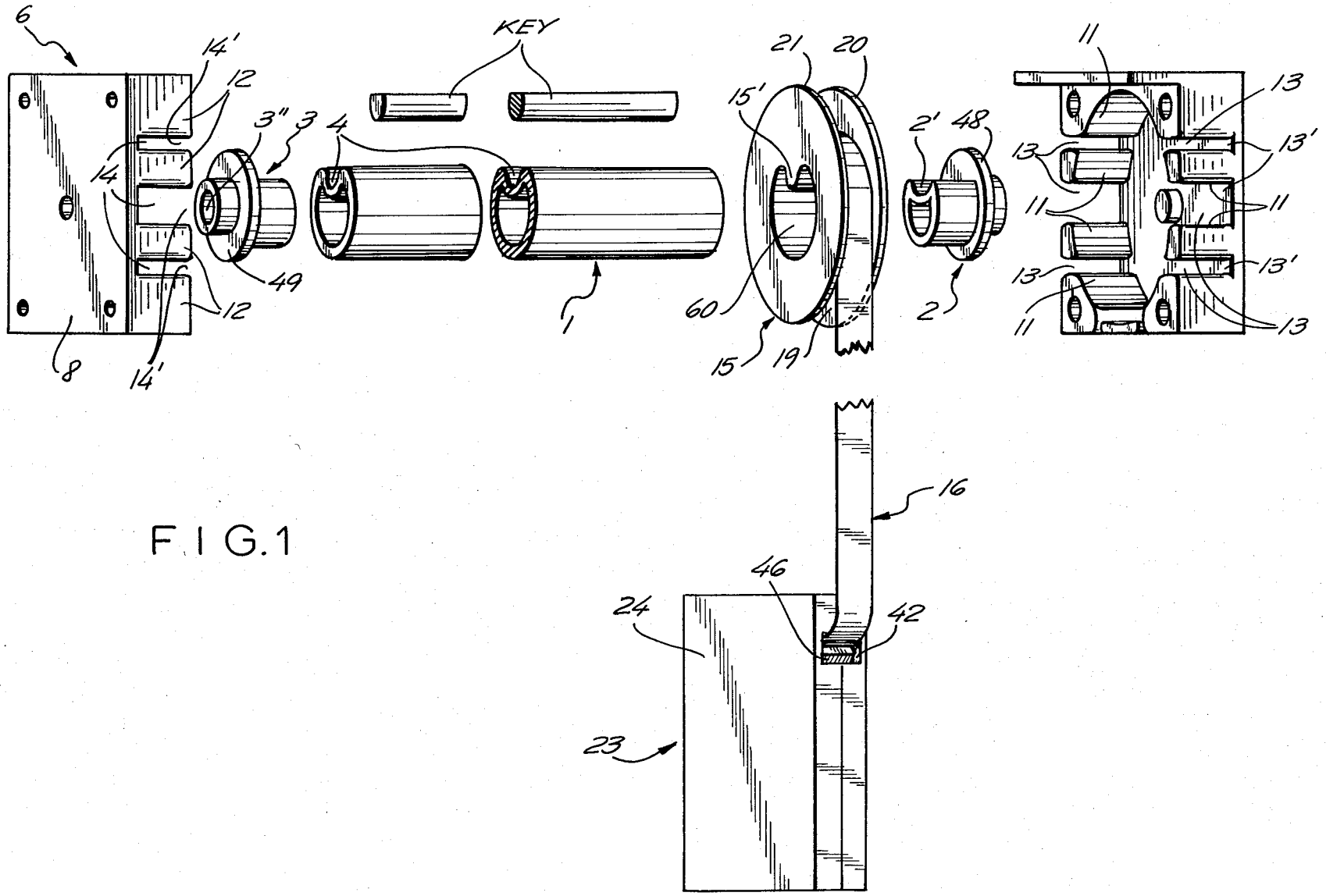
FIG. 1 is an exploded perspective view of the overall shading system according to the present invention.

Referring to FIGS. 1, 5, 6, and 7, a hollow, cylindrical curtain tube 1, illustrated in broken view, is adapted to engage two mounting caps 2 and 3 at respective ends. Tube 1 is substantially circular in cross-section, except for a longitudinally-extending indentation or keyway 4. When the shading system is fully-assembled, a key of a shading material will rest securely in the indentation or keyway 4 as the tube 1 turns, winding or unwinding shade. The mounting caps 2 and 3 are provided with correspondingly mating notches 2' and 3' to engage the cross-sectional contour of tube 1.

The shading system as illustrated in these figures also comprises two end supports 5 and 6 designed to be affixed to a wall support or similar stationary structure. Each end support 5 and 6 having substantially rectangular sides 7, 8 and roofs 9, 10 respectively, are also provided with longitudinally-extending projections 11 and 12, defining respective slots 13 and 14. When the shading system is fully-assembled, the shade may be placed through any correspondingly positioned pair of slots 13, 14 to provide any desired appearance as the shade is raised or lowered. For example, the shade may be passed through any of the front slots 13' and 14' to obscure the pulley 15 and strap 16 from view.

Both end supports 5 and 6 are provided with fixed axles 17 and 18 designed to retain mounting caps 2 and 3 throug respective holds 2" and 3" in the mounting caps while permitting the tube 1 to freely rotate, winding or unwinding the shade.

The inner surfaces of both the left and right end supports 5 and 6 are shaped to accommodate the contours of pulley 15, hence both lateral end supports 5, 6 are interchangeable. Pulley 15, substantially circular in dimension with an inner winding track 19 and two outer flanges 20 and 21, is designed to turn the entire winding mechanism of the shading system, notably tube 1, to wind or unwind the curtain. Strap 16 is wound around running track 19 of the pulley 15. Additionally, inner hole 60 which passes through the entire length of pulley 15 is provided with a projection or key 15" designed to mate with corresponding keyways 2' and 4 in mounting cap 2 and tube 1, to accommodate the winding mechanism of this shading system. Alternatively, pulley 15 may be provided with a retaining screw or rivet which is drilled through the pulley 15 into the tube 1 to secure the pulley 15 in place around the tube 1. Cap 2 is positioned between axle 17 of end support 5 and pulley 15 in assembling the shading system, and extends through hole 60 of pulley 15 to mate with tube 1. As a practical matter, tube 1 mates completely over mounting caps 2 and 3 up to the mounting cap shoulders 48 and 49, so that the outer surface and keyway 4 of tube 1 engages the pulley 15 and its projection or key 15' through the pulley hole 60.

Strap 16, which is wound around track 19 of pulley 15, is fastened at its outer end to the control mechanism 23. Control mechanism 23 comprises an outer container 24 with an approximately rectangular cross-section. The container 24 comprises two separate halves 25 and 26 as illustrated in FIG. 2, which are joined together by screw arrangements 27, 28, 29, and 30 into respective holes 27', 28', 29', and 30' in container halve 26 and 27", 28", 29", and 30" in container halve 25, across partition 31, as illustrated in FIG. 2.

Figure 6:
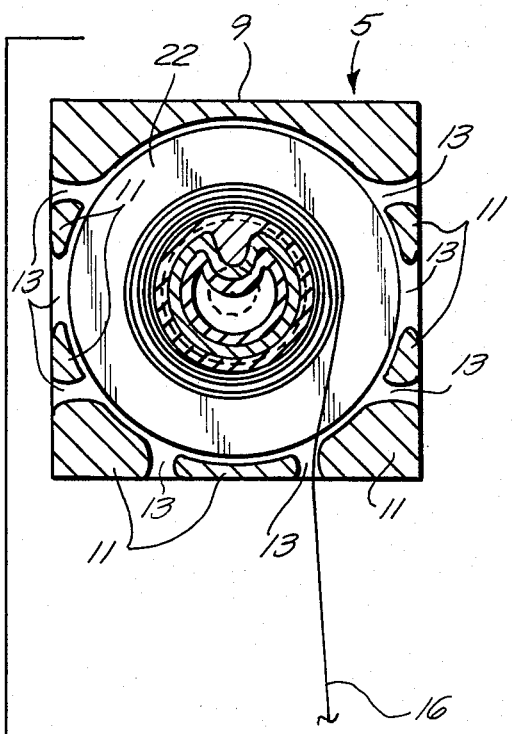
FIG. 6 is a sectional view along line 6—6 of FIG. 5, including the control mechanism.
Figure 6:
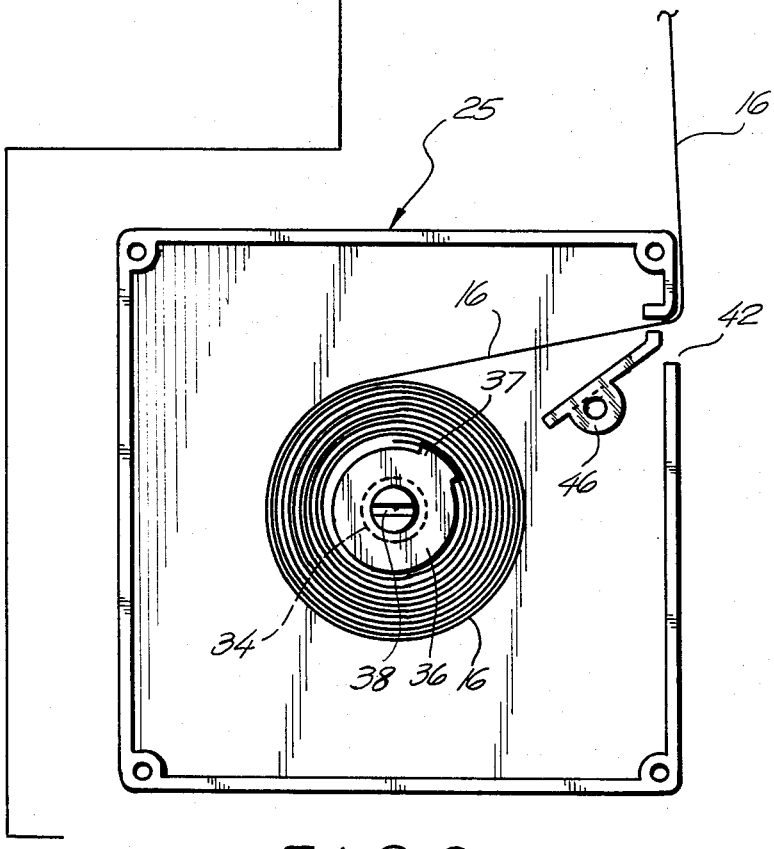

Partition 31 divides container 24 into two separate compartments, strap compartment 32 and spring compartment 33. The inner surface of container halve 25 is provided with a fixed axle 34 at its approximate center, which is designed to mate with a cavity formed in a free-spinning strap hub 35, illustrated in FIG. 3. The strap hub 35 fits over axle 34 as illustrated in FIG. 2. Referring to FIG. 3, the strap hub 35 comprises a base shaft 36, on which catch 37 is formed. When strap 16 is connected with control mechanism 23 as illustrated in FIGS. 1 and 6, the end of strap 16, which is usually attached to a hook, is clipped onto catch 37 of strap hub 35. The end of the base shaft 36 of strap hub 35 opposite the cavity for engaging fixed axle 34 is formed into a smaller extended shaft 38, best seen in FIG. 3 (the base and extended shafts are approximately circular in cross-section). Extended shaft 38 is designed to pass through hole 39 in partition 31, and is provided with slot 40 to ultimately engage a tension spring or coil 41 on the other side of partition 31 in the spring compartment 33. When strap 15 is fastened to the strap hub 35, the strap passes through slot 42 into strap compartment 32, past the pivotal gripping mechanism 46 illustrated in FIGS. 4 and 6 to be further explained infra).

Figure 2:
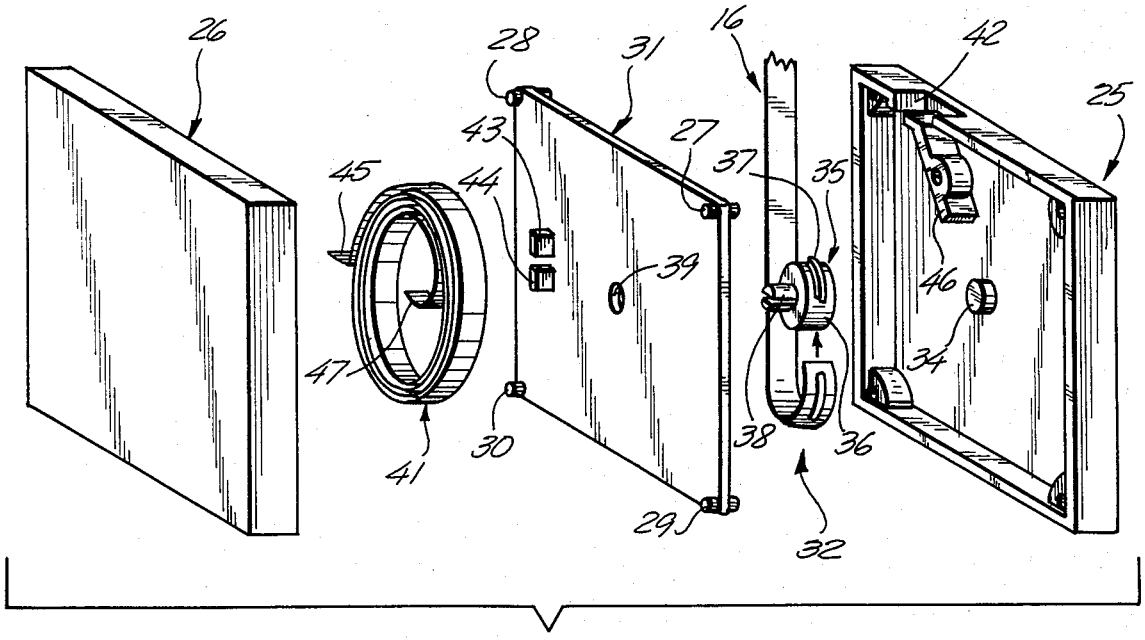
FIG. 2 is an exploded perspective view of the control mechanism of the shading system.
Figure 3:
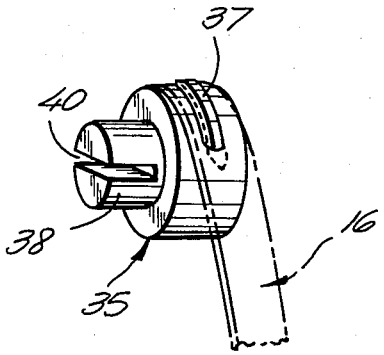
FIG. 3 is an enlarged perspective view in detail of the strap hub in the control mechanism.
Figure 8:
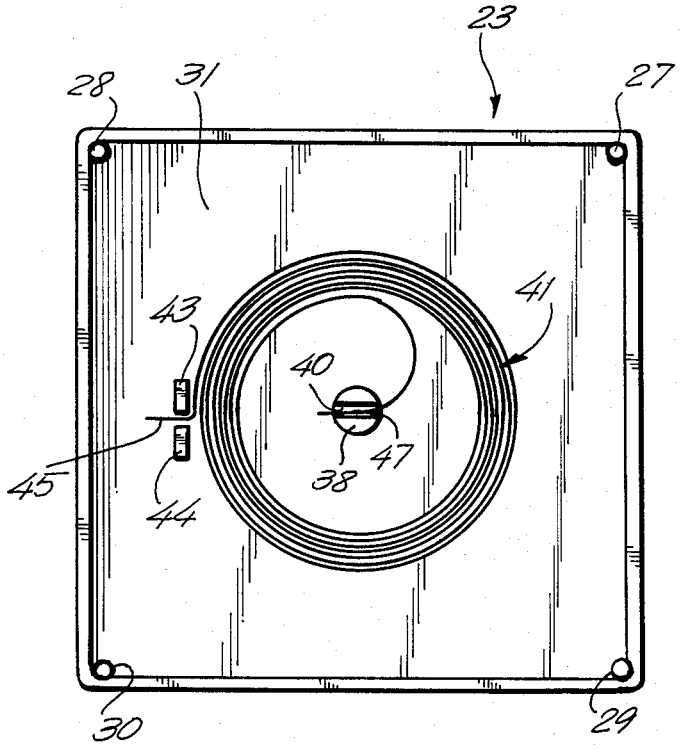
FIG. 8 is an elevational view of a spring inside the control mechanism.
Figure 7:
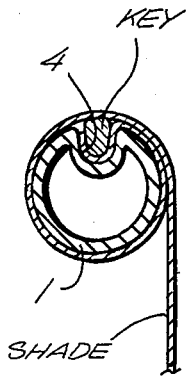
FIG. 7 is a sectional view along line 7—7 of FIG. 5.

The spring compartment side of partition 31 in the control mechanism is provided with two ridges 43 and 44, designed to retain the outer straight end 45 of spring 41, illustrated in FIGS. 2 and 8. When all parts of the entire control mechanism 23 are assembled together, strap 16 is fastened to the base shaft 36 of strap hub 35 as noted previously, and the inner straight end 47 of spring 41 at the center of its coil is engaged into slot 40 on extended shaft 38 of the strap hub 35. This provides a coaxial arrangement of a control strap operating to turn a roller raising or lowering a shade, and of a winding spring or coil along a single, integral shaft within the control mechanism of a shading system. This coaxial arrangement allows for production of a much more compact control mechanism, eliminating the need for one single, continuous strand of control strap or cord plus winding coil. Additionally, the tension spring in the present shading system is wound or unwound from its center, not from its outer end, further adding to the compact nature of the control mechanism in the present shading system.

The present shading system is operated in the following manner. Initially, when the system is in stable condition, the pivotal gripping mechanism presses against strap 16 in slot 42 to hold the strap in place. To disengage the strap 16 from the pivotal grip 46, the strap need only be pulled slightly out of the true vertical position. If it is desired to lower the shade wound around tube 1, then the strap 16 need only be released and will flow in an upward direction and will wind around the running track 19 of the pulley 15, as the shade falls of its own weight rotating tube 1 and concomitantly rotating the pulley 15. All the while the strap hub 36 inside the control mechanism 23 is rotating in the opposite direction, releasing strap 16 and at the same time tightening the spring 41 at its center (the spring 41 and strap 16 are wound around strap hub 36 in opposite directions).

Figure 4:
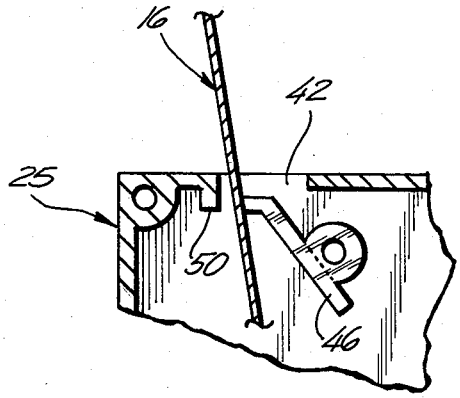
FIG. 4 is an enlarged fragmentary view of the pivotal gripping mechanism within the control mechanism.
Figure 5:
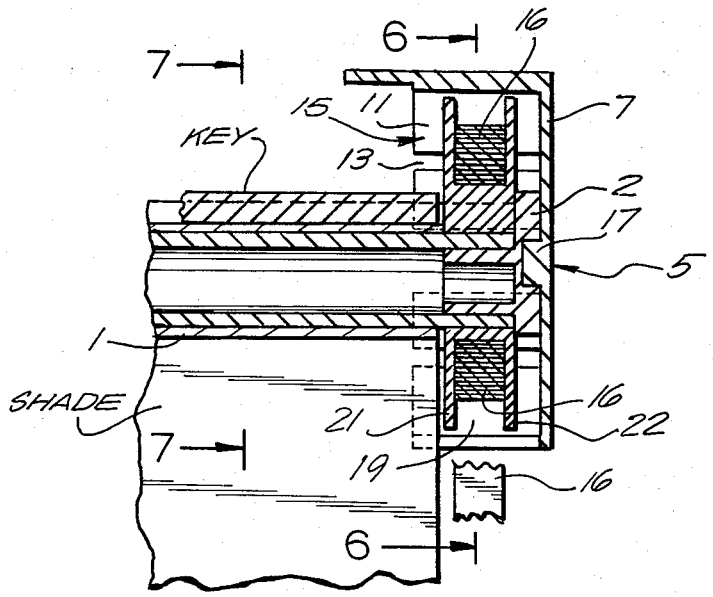
FIG. 5 is a partial sectional view of the assembly of the shading system.

When the shade has been lowered to a desired height, the hold on strap 16 may be slackened so that the strap 16 returns to the true vertical position and the pivotal grip 46 once again presses the strap 16 against the anvil or edge 50 of the control mechanism container halve 25, as illustrated in FIGS. 4 and 6. When it is desired to raise the shade, then the strap 16 need only be pulled out of the true vertical position to disengage the pivotal grip 46 as in the first instance, and the strap 16 is gradually pulled downwardly to raise the shade which winds up around the tube 1 accordingly. As the strap 16 is pulled downwardly, strap hub 35 rotates to wind up the strap 16, at the same time loosening the spring or coil 41 from its center 47. This coaxial tension release from the center of the spring or coil 41 operates to keep the strap 16 tight as it winds around the strap hub 35, so that the entire length of the strap 16 remains taut between the pulley 15 and the strap hub 35. The winding and unwinding of the spring 41 from its center adds to the stability of the entire shading system and supports the compact nature of the control mechanism 23 in that the spring or coil is not unwinding from its outer edge.

The shading system of the present invention may be assembled in any conventional fashion. The shading system of the present invention may comprise any convenient dimensions. Preferably, the tube 1 is about $1\frac{3}{4}$ inches in diameter and about 70 inches in length with the mounting caps 2 and 3 each about $1\frac{1}{2}$ inches in length with diameters about $1\frac{3}{4}$ inches or slightly smaller than the hollow diameter of $1\frac{1}{2}$ inches of tube 1. The radius of curvature of the various indentations or keyways 2', 3', and 4 in the respective mounting caps 2 and 3 and the tube 1 is about $\frac{1}{4}$ inches (the shoulders 48 and 49 in the mounting caps are about $1\frac{7}{8}$ inches in diameter, slightly greater than the outer diameter of tube 1). Holes 2" and 3" in the mounting caps 2 and 3 are about $\frac{3}{4}$ inches in diameter to accommodate fixed axles 17 and 18 of the respective end supports 5 and 6 of about 11/16 inches in diameter).

Pulley 15 is about 2.5 inches in diameter with the diameter of the inner running track 19 about 2 inches. The width of the inner running track 19 is about $\frac{3}{8}$ inches. Hole 60 in the pulley 15 is about $1\frac{3}{4}$ inches in diameter with the radius of curvature of the projection 15' about $\frac{3}{8}$ inches to accommodate mounting cap 2 and tube 1. The two end supports 5 and 6 have sides 7 and 8 about $3\frac{1}{2}$ by $3\frac{1}{2}$ inches and roofs 9 and 10 about $3\frac{1}{2}$ by $2\frac{1}{2}$ inches. The projections 11 and 12 of the end supports 5 and 6 are each at most about $\frac{3}{4}$ inches in length with the individual slots 13 and 14 about $\frac{1}{4}$ inches in width, separated by a width of about $\frac{3}{8}$ inches across each projection (there are preferably about eight slots in all in each end support). The inner surfaces of the projections 11 in end supports 5 and 6 are shaped to form a circle of approximately 3 inches in diameter to accommodate the pulley 15.

The control mechanism 23 is approximately 3 inches by 3 inches by $\frac{3}{4}$ inches in size. The compactness of the control mechanism allows it to fit any desirably sized window recess. Within the control mechanism, the partition 31 is approximately 3 inches by 3 inches, with the base shaft 36 of the shaft hub 35 about $\frac{3}{4}$ inches in length and $\frac{1}{2}$ inches in diameter and the extended shaft 38 about $\frac{1}{4}$ inches in length and about $\frac{1}{4}$ inches in diameter. The recess in strap hub 36 is about $\frac{1}{2}$ inches in diameter and is designed to snugly fit over a fixed axle 34 of slightly less than about $\frac{1}{2}$ inches in diameter. The catch 37 on the base shaft 36 is about $\frac{1}{4}$ inches in length along its surface with a width of about $\frac{1}{8}$ inches. Hole 39 in partition 31 is about $\frac{3}{8}$ inches in diameter while the slot 40 in the extended shaft 38 is slightly less than about $\frac{1}{4}$ inches in length along the extended shaft 38.

Spring or coil 41, constructed of a suitable material such as spring steel, has a width of about 3/16 inches and any suitable length to fit in the control mechanism. Strap 16 has about 16 feet capacity and about 3/16 inches width, allowing it to conveniently wind around both the pulley 15 and strap hub 35, and fit through slot 42 of the control mechanism 23 which is about $\frac{3}{4}$ inches by $\frac{1}{2}$ inches. Altogether, the width of strap compartment 32 between container halve 25 and partition 31 is about $\frac{1}{2}$ inches, while the width of the spring compartment between partition 31 and container halve 26 is about $\frac{1}{4}$ inches. All suggested dimensions are subject to standard machining tolerances. The various components of the present invention may be fabricated from any suitable materials such as wood, plastic, metal.

The previously-described embodiment is illustrative of the present invention and is not intended to limit the scope thereof.

What is claimed is:

1. A shading system comprising:

(a) a shade;

(b) a strap or cord for winding and unwinding said shade;

(c) a hub, said strap or cord being wound about said hub at an end opposite said shade;

(d) a coil spring, said coil spring being wound about said hub coaxially with said strap or cord, the outer end of said coil spring being stationary, the inner end of said coil spring being affixed to said hub, so that said coil spring winds or unwinds from its center as said hub turns;

(e) a roller or tube, said roller or tube supporting said shade as it hangs, with said strap or cord being wound around said roller or tube at its end opposite said hub;

(f) a hollow pulley, said roller or tube being inserted through said pulley, said strap or cord being wound around said pulley at the end opposite said hub;

(g) a pivotal grip for engaging said strap or cord between said pulley and said hub, to secure said strap or cord against movement, thereby maintaining said shade at a certain height;

(h) a pair of supports for said roller or tube, each of said supports being at one of the ends of said roller or tube and supporting said roller or tube, each of said end supports being provided with a series of slots through which said shade wound around said roller or tube passes, to allow said shade to hang in a direction other than directly down from said roller or tube; and (i) a key, said roller or tube being provided with a keyway at an end of said shade for receiving said key, as said shade is wound around said roller or tube.

2. The system of claim 1 in which said hub, coil spring, and pivotal grip together form a control mechanism for raising and lowering the shade.

3. The system of claim 2 in which the strap or cord, and the coil spring, are wound about the hub in opposite directions.

4. The system of claim 3 in which the control mechanism is in the form of a box with a partition in its center, the hub extending through a hole in the center of said partition, and with the strap or cord and the coil spring being wound around the hub on opposite sides of said partition.

5. The system of claim 4 in which the strap or cord extends into the control mechanism through an opening on the box, with the pivotal grip positioned to engage the strap or cord at the opening, against an anvil of the box.

* * * * *